US011147428B2

(12) United States Patent
Metzel et al.

(10) Patent No.: US 11,147,428 B2
(45) Date of Patent: Oct. 19, 2021

(54) FLOOR MOP

(71) Applicant: Carl Freudenberg KG, Weinheim (DE)

(72) Inventors: Doug Metzel, Lombard, IL (US); Eric Wehrli, Oswego, IL (US)

(73) Assignee: Carl Freudenberg KG, Weinheim (DE)

( * ) Notice: Subject to any disclaimer, the term of this patent is extended or adjusted under 35 U.S.C. 154(b) by 159 days.

(21) Appl. No.: 16/528,083

(22) Filed: Jul. 31, 2019

(65) Prior Publication Data

US 2021/0030251 A1 Feb. 4, 2021

(51) Int. Cl.
*A47L 13/22* (2006.01)
*A47L 13/254* (2006.01)
*A47L 13/20* (2006.01)

(52) U.S. Cl.
CPC ..... *A47L 13/22* (2013.01); *A47L 13/254* (2013.01); *A47L 13/20* (2013.01)

(58) Field of Classification Search
CPC ..... A47L 13/22; A47L 13/254; A47L 13/00; A47L 13/10; A47L 13/16; A47L 13/20; A47L 13/225; A47L 13/26
USPC ..... 401/136–139; 15/147.1, 143.1, 144.1, 15/144.3
See application file for complete search history.

(56) References Cited

U.S. PATENT DOCUMENTS 3,977,570 A 8/1976 Smrt
6,540,424 B1 * 4/2003 Hall ..... A47L 13/22 401/138
7,480,956 B2 * 1/2009 Policicchio ..... A47L 13/16 134/6
8,186,898 B2 * 5/2012 Bradbury ..... A47L 13/22 401/139
2004/0146332 A1 7/2004 Fu
2007/0209139 A1 9/2007 Carlucci et al.

FOREIGN PATENT DOCUMENTS

DE 202004010429 U1 10/2004
WO WO 01/72195 A1 10/2001
WO WO 2006/002919 A1 1/2006

OTHER PUBLICATIONS

European Patent Office, International Search Report in International Patent Application No. PCT/IB2020/057037, 5 pp. (dated Oct. 29, 2020).
European Patent Office, Written Opinion in International Patent Application No. PCT/IB2020/057037, 8 pp. (dated Oct. 29, 2020).

* cited by examiner

*Primary Examiner* — David J Walczak
(74) *Attorney, Agent, or Firm* — Leydig, Voit & Mayer, Ltd.

(57) ABSTRACT

An actuable shaft assembly for a spray mop assembly includes first and second hollow elongated outer shaft segments in which first and second elongated actuating rod segments are telescopingly disposed, respectively. The first and second outer shaft segments include respective first and second shaft retaining elements extending into their hollow interiors. The first and second rod segments include respective first and second rod retaining elements extending radially outward from their outer peripheral surfaces. The rod retaining elements and shaft retaining elements are sized and disposed to limit telescoping movement of the associated rod segments outward from the shaft segment ends.

14 Claims, 5 Drawing Sheets

FLOOR MOP

FIELD OF THE DISCLOSURE

The present disclosure relates to spray mops and similar devices, and more specifically to spray mops including an user operable actuation assembly extending through the interior of a shaft of the device.

BACKGROUND OF THE INVENTION

Floor sweepers or mops may be used dry or in conjunction with a liquid or spray material that aids cleaning with the mop. Spray mops are typically constructed with a flat plate, upon which a cover is disposed. The cover may be formed of a synthetic or natural fabric or the like, or combinations thereof. The cover both provides scrubbing action on a surface to be cleaned and absorbent and/or attractive qualities to pick up and retain both solids and liquids. The plate of the mop is typically attached at a central portion thereof to a shaft and handle via a universal or multidirectional joint that provides freedom of movement in multiple directions between the shaft and the plate such that a user can easily direct the mop plate along a desired path.

Actuation of the spray function in a spray mop is often controlled by a trigger adjacent the handle at a proximal end of the shaft. An actuation assembly may include an interior actuating rod that extends through an outer shaft to transmit the movement of the trigger to a spray nozzle at the distal end of the spray mop. Because of the complexity of the actuable shaft assembly, spray mops are often shipped and provided with the actuable shaft assembly in a fully assembly state. Some manufacturers have attempted to construct arrangements wherein the actuable shaft assembly is disassembled for shipping. In arrangements where the actuable shaft assembly is provided in a disassembled state, however, interior actuating rod segments may become separated from the outer shaft segments. While some manufacturers have attempted to provide shipping arrangements wherein the various elements of the actuable shaft assembly are coupled to prevent the interior actuating rod segments from separating from the outer shaft segments, those proposed solutions include a relatively large number of additional components and may significantly increase the cost of the spray mop.

SUMMARY OF THE DISCLOSURE

In one aspect, the disclosure describes a spray mop having at least a first outer shaft segment, a second outer shaft segment. The first outer shaft segment has a proximal first shaft segment end and a distal first shaft segment end. The second outer shaft segment has a proximal second shaft segment end and a distal second shaft segment end. The distal first shaft segment end is coupled to the proximal second shaft segment end to form an outer shaft assembly having a shaft proximal end and a shaft distal end. The first and second outer shaft segments of the outer shaft assembly define an elongated hollow interior. The spray mop further includes a handle coupled to the shaft proximal end, and a mop plate coupled to the shaft distal end at a joint. A selectively actuable spray assembly is disposed substantially adjacent the shaft distal end. The spray assembly includes a spray nozzle fluidly coupled to a reservoir. The spray mop further includes a user operable actuation assembly. The user operable actuation assembly includes a trigger movably coupled to the handle, an actuable dispensing connection disposed to selectively actuate the selectively actuable spray assembly, and an actuating rod disposed for telescoping movement within the elongated hollow interior of the outer shaft assembly between the trigger and the actuable dispensing connection. The actuating rod includes at least a first elongated actuating rod segment and a second elongated actuating rod segment. The first elongated actuating rod segment has a first outer peripheral surface, a proximal first rod segment end, and a distal first rod segment end. The second elongated actuating rod segment has a proximal second rod segment end and a distal second rod segment end. The distal first rod segment end is disposed adjacent the proximal second rod segment end. A first rod retaining element extends radially outward from and is coupled for movement with the first elongated actuating rod segment. A second rod retaining element extends radially outward from and is coupled for movement with the second elongated actuating rod segment. A first shaft retaining element is secured to and extends radially inward from the first outer shaft segment into the elongated hollow interior. A second shaft retaining element is secured to and extends radially inward from the second outer shaft segment into the elongated hollow interior. The first rod retaining element and first shaft retaining element are disposed and sized such that the first shaft retaining element interferes with the first rod retaining element to limit telescoping movement of the first rod retaining element within the first shaft retaining element, and the second rod retaining element and second shaft retaining element are disposed and sized such that the second shaft retaining element interferes with the second rod retaining element to limit telescoping movement of the second rod retaining element within the second shaft retaining element.

The disclosure describes in another aspect, a spray mop including first and second subassemblies. The first subassembly includes a first elongated outer shaft segment, and a first elongated actuating rod segment disposed for telescoping movement within a first elongated hollow interior of the first elongated outer shaft segment. The first elongated outer shaft segment has a proximal first shaft segment end and a distal first shaft segment end, while the first elongated actuating rod segment has a first outer peripheral surface, a proximal first rod segment end, and a distal first rod segment end. A first shaft retaining element is secured to and extends radially inward from the first elongated outer shaft segment into the first elongated hollow interior. A first rod retaining element extends radially outward from the first outer peripheral surface and is coupled for movement with the first elongated actuating rod segment. A handle is secured to the proximal first shaft segment end, and a trigger movably coupled to the handle and disposed to selectively exert a force on the proximal first rod segment end to selectively telescope the first elongated actuating rod segment within the first elongated outer shaft segment. The first rod retaining element is disposed between the first shaft retaining element and the handle. The first rod retaining element and the first shaft retaining element are sized to limit telescoping movement of the first elongated actuating rod segment from the first elongated outer shaft segment;

The second subassembly includes a second elongated outer shaft segment, and a second elongated actuating rod segment disposed for telescoping movement within a second elongated hollow interior of the second elongated outer shaft segment. The second elongated outer shaft segment has a proximal second shaft segment end and a distal second shaft segment end, while the second elongated actuating rod segment has a second outer peripheral surface, a proximal second rod segment end, and a distal second rod segment end. A second shaft retaining element is secured to and extends radially inward from the second elongated outer shaft segment into the second elongated hollow interior. A second rod retaining element extends radially outward from the second outer peripheral surface and is coupled for movement with the second elongated actuating rod segment. The second rod retaining element is disposed between the second shaft retaining element and the distal second shaft segment end. The second rod retaining element and the second shaft retaining element are sized to limit telescoping movement of the second elongated actuating rod segment from the second elongated outer shaft segment. The distal first shaft segment end and the proximal second shaft segment end are adapted to be coupled together to align the distal first rod segment end with the proximal second rod segment end.

In yet another aspect, the disclosure describes an actuable shaft assembly for a spray mop assembly includes an actuable spray assembly, a handle, and trigger. The actuable shaft assembly includes first and second elongated outer shaft segments defining first and second elongated hollow interiors, respectively, and first and second elongated actuating rod segments disposed for telescoping movement within the first and second elongated hollow interiors, respectively. The second elongated outer shaft segment has proximal and distal second shaft segment ends, while the first elongated outer shaft segment has proximal and distal first shaft segment ends, the proximal first shaft segment end being adapted to be secured to the handle. The first elongated actuating rod segment has a first outer peripheral surface, and proximal and distal first rod segment ends, while the second elongated actuating rod segment has a second outer peripheral surface, and proximal and distal second rod segment ends. A first shaft retaining element is secured to and extends radially inward from the first elongated outer shaft segment into the first elongated hollow interior, and a first rod retaining element extends radially outward from the first outer peripheral surface and is coupled for movement with the first elongated actuating rod segment. The first rod retaining element is disposed between the first shaft retaining element and the proximal first shaft segment end, the first rod retaining element and the first shaft retaining element being sized to limit telescoping movement of the first elongated actuating rod segment outward from the distal first shaft segment end. A second shaft retaining element is secured to and extends radially inward from the second elongated outer shaft segment into the second elongated hollow interior, and a second rod retaining element extends radially outward from the second outer peripheral surface and is coupled for movement with the second elongated actuating rod segment. The second rod retaining element is disposed between the second shaft retaining element and the distal second shaft segment end, the second rod retaining element and the second shaft retaining element being sized to limit telescoping movement of the second elongated actuating rod segment from the proximal second shaft segment end. The distal first shaft segment end and the proximal second shaft segment end are adapted to be coupled together to align the distal first rod segment end with the proximal second rod segment end.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims. The terms configured and configuration as used herein refer to a specified structural size and shape capable of a particular function or operation.

Figure 1:
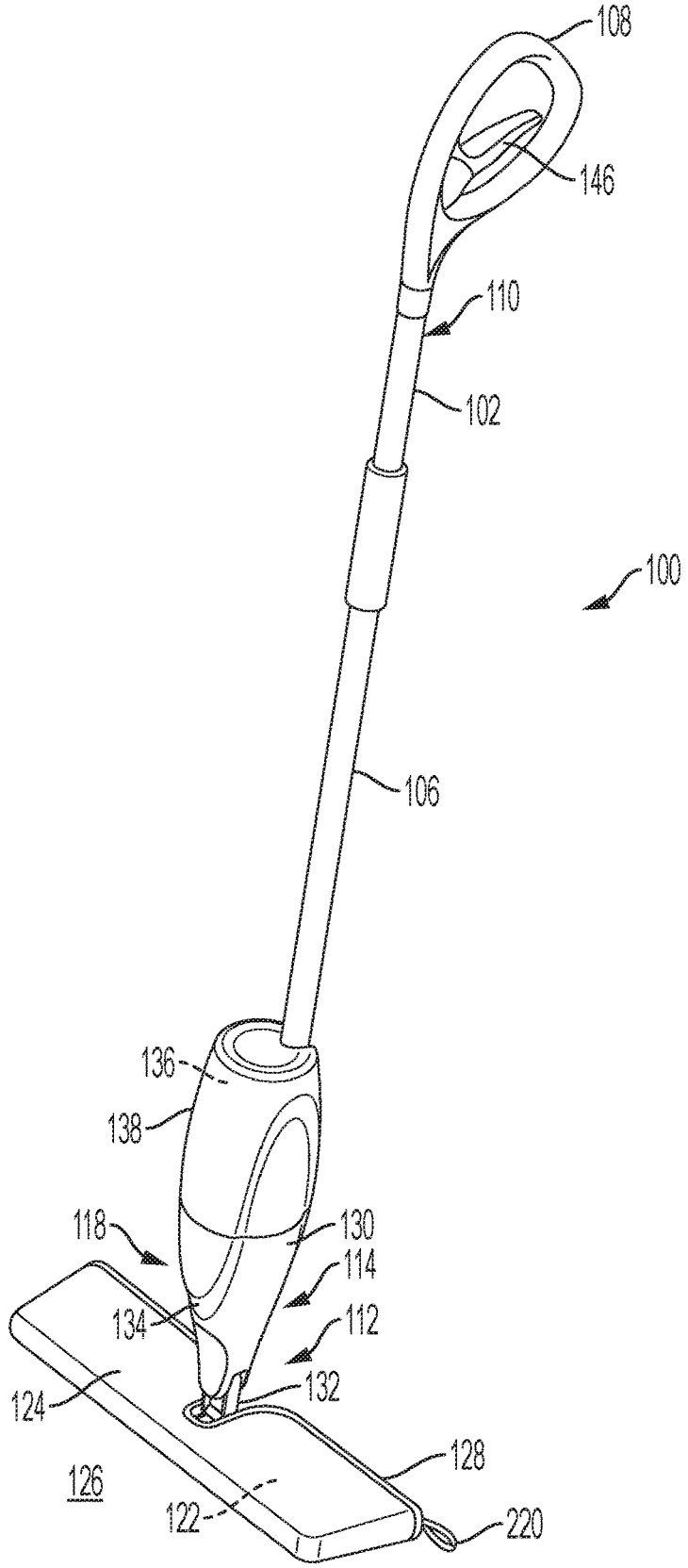
FIG. 1 is an isometric view of a spray mop according to one embodiment of the disclosure.

The invention is directed to a spray mop 100, and, more particularly, to an actuable shaft assembly 102 suitable for use in a spray mop. Referring to FIG. 1, the floor or spray mop 100 can include an actuable shaft assembly 102 having a handle 108 at a shaft proximal end 110, and a cleaning end 112 at a shaft distal end 114. The actuable shaft assembly 102 includes and outer shaft assembly 106 having a hollow interior 116 as discussed further below. The handle 108, which is disposed at or near the shaft proximal end 110 of the mop 100, can be used to grip and guide the spray mop 100 in a desired direction.

The cleaning end 112 includes a selectively actuable spray assembly 118 and a mop plate 122. A replaceable cleaning pad 124 may be disposed on the mop plate 122. That is, the mop plate 122 is sized and shaped to receive a cleaning pad 124 (FIG. 1). The cleaning pad 124 can be any suitable type for any suitable working surface 126 to be cleaned, such as disposable or reusable cleaning pads 124 or coverings (such as microfiber cleaning pads 124). The cleaning pad 124 may be made of synthetic or natural materials or combinations thereof. The cleaning pad 124 may be shaped by two layers of fabric. Each layer of fabric may have an outer, cleaning side and an inner side. The layers are placed adjacent one another with their inner sides in facing relation, and are attached to one another along at least three sides around their perimeter. The fourth side 128 is left at least partially unattached to form an internal pocket. In assembling the cleaning pad 124 to the cleaning end 112 of the mop, the mop plate 122 is placed in the pocket of the cleaning pad 124 to retain the cleaning pad 124 thereon.

The mop plate 122 may be coupled to the outer shaft assembly 106 either directly or through a structure coupled to the outer shaft assembly 106, such as a spray housing 130, which will be discussed further below. In the illustrated embodiment, the mop plate 122 is coupled to the outer shaft assembly 106 by way of a multidirectional joint 132 coupled to the spray housing 130, although an alternative arrangement may be provided. The multidirectional joint 132 provides freedom of movement in multiple directions between the spray housing 130 and the cleaning end 112 such that a user can easily direct and steer the cleaning end 112 along a desired path. While other embodiments are envisioned, in the illustrated embodiment, the multidirectional joint 132 allows the outer shaft assembly 106 and spray housing 130 to pivot around fore-aft and lateral arcuate axes.

The selectively actuable spray assembly 118 of the illustrated embodiment is disposed substantially adjacent the shaft distal end 114, and includes a spray nozzle 134 fluidly coupled to a reservoir 136. The reservoir 136 may be, for example, a removable, refillable bottle 138 supported on the outer shaft assembly 106 by a spray housing 130, and may include a selectively actuable valve 142. The spray nozzle 134 is disposed on the spray housing 130 to spray a cleaning solution contained in the reservoir 136 toward the cleaning surface. While the spray nozzle 134 is disposed on front surface of the spray housing 130 to spray the cleaning solution in front of the mop plate 122 in this embodiment, the spray nozzle could be disposed along another surface. For example, the spray nozzle 134 could be disposed along a rear surface of the spray housing 130 to spray the cleaning solution behind the mop plate 122.

In order to facilitate a user's actuation of the selectively actuable spray assembly 118 at the shaft distal end 114 from the shaft proximal end 110, the spray mop 100 additionally includes a user operable actuation assembly 144. The user operable actuation assembly 144 includes a trigger 146 movably coupled to the handle 108 at the shaft proximal end 110, an actuable dispensing connection 148 disposed to selectively actuate the selectively actuable spray assembly 118 at the shaft distal end 114, and an actuating rod 150 disposed for telescoping movement within the elongated hollow interior 116 of the outer shaft assembly 106 between the trigger 146 and the actuable dispensing connection 148.

Figure 2:
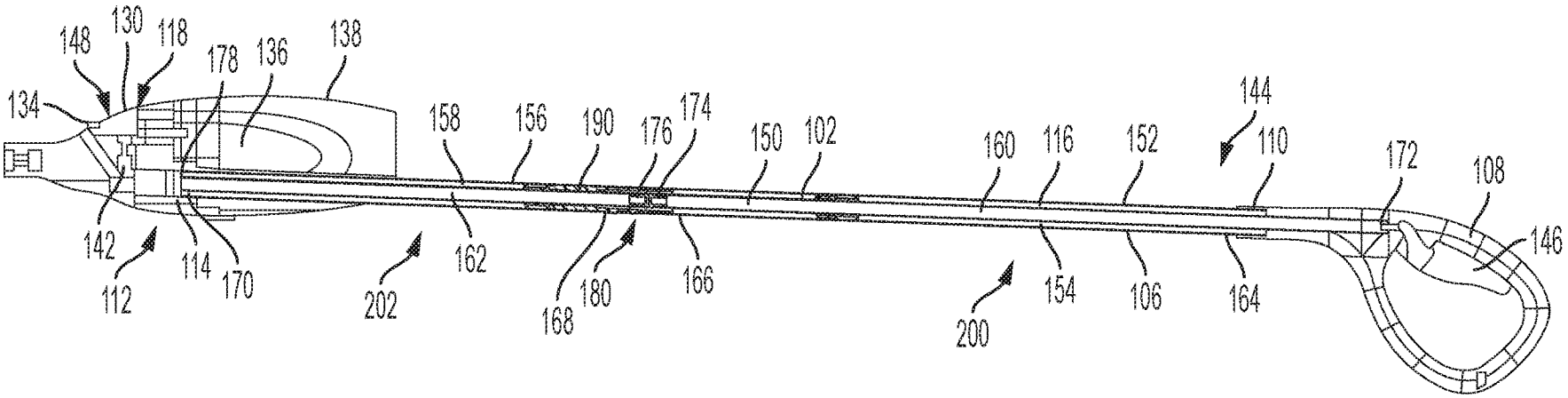
FIG. 2 is a fragmentary cross-sectional view of the spray mop of FIG. 1.

The trigger 146 is disposed to provide a telescoping movement of the actuating rod 150 within the elongated hollow interior 116 of the outer shaft assembly 106 in order to actuate the actuable dispensing connection 148. The resulting telescoping movement of the actuating rod 150 within the outer shaft assembly 106 may be such that the actuating rod 150 telescopes outward toward the shaft distal end 114 or inward toward the shaft proximal end 110, depending upon the design of the actuable dispensing connection 148. In the illustrated design, the trigger 146 is coupled to bear on a proximal end of the actuating rod 150 to actuate the actuable dispensing connection 148. The trigger 146 is disposed in an unactuated position as illustrated in FIG. 1, and the trigger 146 and actuating rod 150 are disposed in the actuated position in FIG. 2. While the trigger 146 is illustrated to bear directly on the actuating rod 150, a further coupling structure may be provided between the trigger 146 and the actuating rod 150 to cause telescoping movement of the actuating rod 150 within the outer shaft assembly 106.

The trigger 146 may be of any appropriate design to provide the desired movement of the actuating rod 150 within the outer shaft assembly 106 to cause operation of the actuable dispensing connection. For example, the trigger 146 may be a lever that is pivotably coupled to the handle 108 such that pivoting the trigger 146 results in the desired motion. Alternatively, the trigger 146 may be disposed to move linearly relative to the handle 108. For example, the trigger 146 may be generally disposed perpendicularly to and coupled to the actuating rod 150 such that a linear movement of the trigger 146 along an axis or parallel to an axis including the actuating rod 150 would provide an associated movement of the actuating rod 150 along its axis.

As will be appreciated by those of skill in the art, the actuable dispensing connection 148 may be of any appropriate design known in the art. By way of example only, the actuable dispensing connection 148 may include a pump arrangement that dispenses a given volume of cleaning fluid from the reservoir 136 through the spray nozzle 134 when an actuating force is applied, or that provides cleaning fluid under pressure through the spray nozzle 134. For example, a given volume of cleaning fluid may be contained in or adjacent a valve of the reservoir 136 such that the given volume is provided to the when the actuating force is applied. Alternatively, the actuable dispensing connection 148 may be advanced to an open position when the actuating force is applied, providing a steady stream of cleaning fluid through the actuable dispensing connection 148 to the spray nozzle 134.

In order to minimize the size of the spray mop 100 during shipment and/or display, the outer shaft assembly 106 and the actuating rod 150 may include a plurality of segments, thereby allowing the effective length of the spray mop 100 to be shortened. For example, the outer shaft assembly 106 and the actuating rod 150 may each include two or more segments that may then be coupled end to end to assemble the spray mop 100. While the further discussion of the structure is directed to an outer shaft assembly 106 and an actuating rod 150 each having two segments, those of skill in the art will appreciate that the disclosure is equally applicable to an arrangement including three or more such subassemblies.

Figure 3:
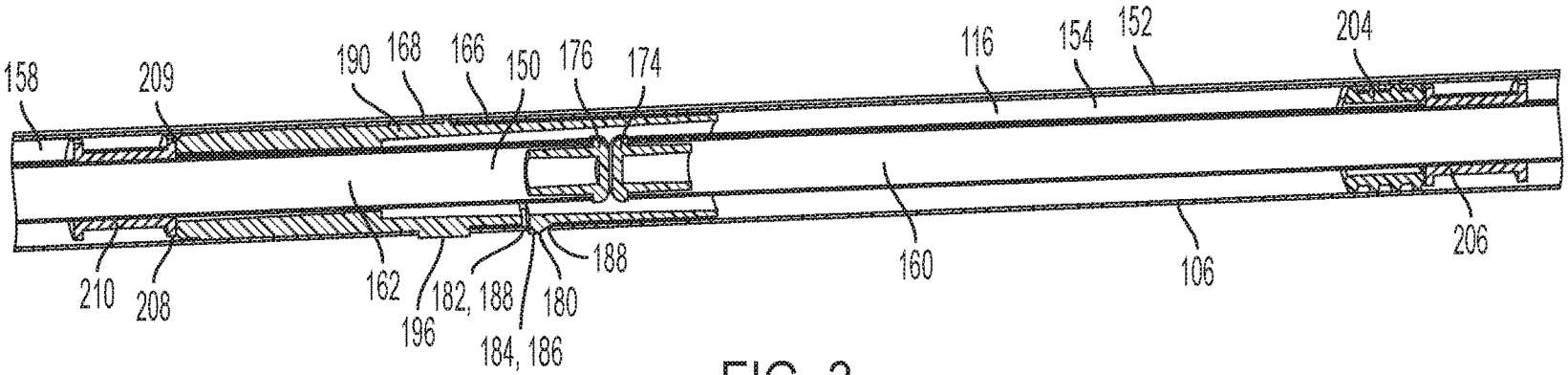
FIG. 3 is an enlarged fragmentary cross-sectional view of the actuable shaft assembly and actuation rod of the spray mop of FIGS. 1 and 2.
Figure 4:
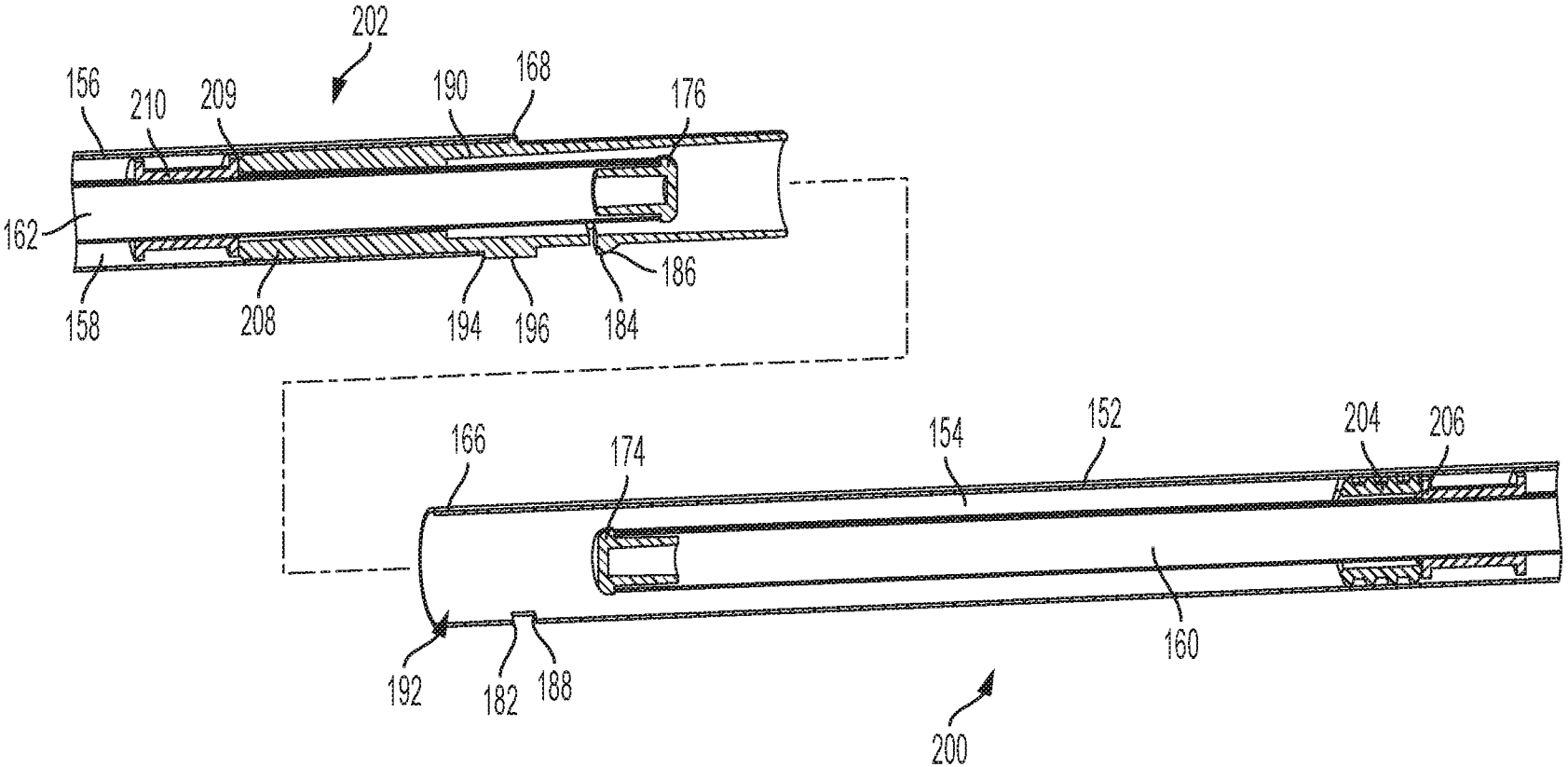
FIG. 4 is an exploded enlarged fragmentary cross-sectional view of the actuable shaft assembly and actuation rod of the spray mop of FIGS. 1 and 2.

Referring to FIGS. 3 and 4, in particular, the outer shaft assembly 106 may include at least a first elongated outer shaft segment 152 having a first elongated hollow interior 154 and a second elongated outer shaft segment 156 having a second elongated hollow interior 158. Similarly, the actuating rod 150 may include a first rod segment 160 disposed within the first elongated hollow interior 154 and second rod segment 162 disposed within the second elongated hollow interior 158. The first elongated outer shaft segment 152 includes a proximal first shaft segment end 164 and a distal first shaft segment end 166, while the second elongated outer shaft segment 156 includes a proximal second shaft segment end 168 and a distal second shaft segment end 170. Similarly, the first rod segment 160 includes a proximal first rod segment end 172 and a distal first rod segment end 174, while the second rod segment 162 includes a proximal second rod segment end 176 and a distal second rod segment end 178. In assembly, the distal first shaft segment end 166 is coupled to the proximal second shaft segment end 168 in order to form the outer shaft assembly 106. In this way, the distal first rod segment end 174 is disposed to confront the proximal second rod segment end 176 in order to form the actuating rod 150.

In order to couple the first and second elongated outer shaft segments 152, 156, a coupler 180 is provided. The coupler 180 includes a first engaging structure 182 disposed at a distal first shaft segment end 166 and a second engaging structure 184 at a proximal second shaft segment end 168. In the illustrated embodiment, the second engaging structure 184 includes a protrusion 186 that is radially-biased outward, while the first engaging structure 182 includes a recess or opening 188 in the periphery of the first elongated outer shaft segment 152. The opening 188 is adapted to receive the protrusion 186. It will be appreciated by those of skill in the art that the coupler 180 may be other than as specifically described here. By way of example only, the proximal second shaft segment end 168 and the distal first shaft segment end 166 may include mating threaded structures (not shown).

In this embodiment, the protrusion 186 is unitarily formed with a tubular insert 190 that is disposed within and extends outward from the proximal second shaft segment end 168. The tubular insert 190 may be coupled to the proximal second shaft segment end 168 by any appropriate means, for example, a mechanical interlock, an interference fit, a bonding agent, and/or friction. In this way, the tubular insert 190 extending outwardly from the proximal second shaft segment end may also be received within the distal first shaft segment end 166 in order to provide additional stability to the assembled outer shaft assembly 106.

While the illustrated embodiment disposes the opening 188 in the first elongated outer shaft segment 152 and the protrusion 186 is associated with to the second elongated outer shaft segment 156, and more particularly, the tubular insert 190 associated with the second elongated outer shaft segment 156, the elements could be reversed. That is, the opening 188 could be disposed in the second elongated outer shaft segment 156 and the protrusion 186 is associated with to the first elongated outer shaft segment 152. Likewise, the tubular insert 190 could be associated with the first elongated outer shaft segment 152, and received within the second elongated outer shaft segment 156 to couple the first and second elongated outer shaft segments 152, 156.

Returning to the illustrated embodiment, in order to further ensure proper orientation of the first and second elongated outer shaft segments 152, 156, the first and second elongated outer shaft segments 152, 156 each include a respective longitudinally extending slot 192, 194 which is adapted to receive a guide flange 196 that extends radially outward from the tubular insert 190. In this way, the guide flange 196 and slots 192, 194 facilitate proper orientation of the handle 108 at the shaft proximal end 110 and the cleaning end 112 at the shaft distal end 114.

An overall length of the spray mop 100 may be reduced for shipping and, if desired, display purposes. That is, the spray mop 100 may be provided in a partially disassembled state. While the spray mop 100 may be provided in three or more subassemblies, the following discussion is directed to an arrangement including at least a first subassembly 200 and a second subassembly 202. The first subassembly 200 includes the first elongated outer shaft segment 152, first rod segment 160, and, optionally, the handle 108, and trigger 146. The second subassembly 202 includes the second elongated outer shaft segment 156, second rod segment 162, and, optionally, one or more of the mop plate 122, bottle 138 and reservoir 136, spray housing 130, and spray nozzle 134.

In accordance with the invention, the actuable shaft assembly 102 may be provided in two or more segments or subassemblies. When the shaft assembly 102 is provided in two or more segments or subassemblies 200, 202, the first rod segment 160 is maintained at least partially within the first elongated outer shaft segment 152 by obstructing structure associated with the segments 160, 152 themselves. Alternatively or additionally, the second rod segment 162 is maintained at least partially within the second elongated outer shaft segment 156 by obstructing structure associated with one or both of those segments 162, 156 themselves. Preferably, the first and second rod segments 160, 162 are telescopingly or slidably disposed and maintained at least partially within the first and second elongated outer shaft segments 152, 156 by structure that obstructs the complete separation of the first and second rod segments 160, 162 from the first and second elongated outer shaft segments 152, 156, respectively.

The obstructing structure may be disposed within the first and second elongated outer shaft segments 152, 156, between the first and second rod segments 160, 162 and the first and second elongated outer shaft segments 152, 156, respectively. Turning first to the first subassembly 200, as illustrated in FIGS. 3 and 4, the first elongated outer shaft segment 152 may be provided with a first shaft retaining element 204 secured to and extending radially inward from the first elongated outer shaft segment 152 into the first elongated hollow interior 154. The first shaft retaining element 204 may be formed integrally with or otherwise secured or fixed to the first elongated outer shaft segment 152 by a mechanical interlock, an interference fit, a bonding material, or friction. While any appropriate material may be utilized, in at least one embodiment, the first shaft retaining element 204 is formed of rubber material. In this way, the first shaft retaining element 204 may be assembled into the first elongated outer shaft segment 152 and maintained in position by friction or a combination of an interference fit and friction.

A first rod retaining element 206 may be provided, extending radially outward from first outer peripheral surface of the first rod segment 160. As with the first shaft retaining element 204, the first rod retaining element 206 may be integrally formed with or otherwise secured or fixed to the first rod segment 160 by a mechanical interlock, an interference fit, a bonding material, and/or friction. While any appropriate material may be utilized, in at least one embodiment, the first rod retaining element 206 is formed of rubber material. In this way, the first rod retaining element 206 may be assembled onto the first rod segment 160 and maintained in position by friction or a combination of an interference fit and friction.

When the first rod segment 160 is assembled into the first elongated outer shaft segment 152, the first shaft retaining element 204 is disposed distally to the first rod retaining element 206. That is, the first rod retaining element 206 is disposed between the first shaft retaining element 204 and the handle 108. In this way, telescoping movement of the first rod segment 160 outward from the first elongated outer shaft segment 152 is inhibited as the first shaft retaining element 204 obstructs the passage of the first rod retaining element 206, and, accordingly, the first rod segment 160. While the illustrated first rod retaining element 206 and the first shaft retaining element 204 are both illustrated as annular structures, those of skill in the art will appreciate that alternative structures may be provided, so long as there is an interference such that the first shaft retaining element 204 obstructs passage of the first rod retaining element 206. By way of example only, the first shaft retaining element 204 and first rod retaining element 206 may each extend less than a complete annulus, the first rod retaining element 206 may be an annular structure and the first shaft retaining element 204 may be a probe extending inwardly into the first elongated hollow interior 154 from the first elongated outer shaft segment 152, or the first rod retaining element 206 may be a probe extending outwardly from the first rod segment 160 and the first shaft retaining element 204 may be an annular structure.

Turning to the second subassembly 202, the second elongated outer shaft segment 156 may be provided with a second shaft retaining element 208 secured to and extending radially inward from the second elongated outer shaft segment 156 into the second elongated hollow interior 158. The second shaft retaining element 208 may be formed integrally with or otherwise secured or fixed to the second elongated outer shaft segment 156 by a mechanical interlock, an interference fit, a bonding material, or friction. While any appropriate material may be utilized, in at least one embodiment, the second shaft retaining element 208 is formed of rubber material. In this way, the second shaft retaining element 208 may be assembled into the second elongated outer shaft segment 156 and maintained in position by friction or a combination of an interference fit and friction.

In the illustrated embodiment, the second shaft retaining element 208 is integrally formed with the tubular insert 190. That is, the second shaft retaining element 208 is a distally disposed surface 209 of the tubular insert 190. It will be appreciated, however, that the second shaft retaining element 208 may be a separate structure from the tubular insert 190. Further, it will be appreciated that in an embodiment wherein the tubular insert is primarily associated with the first elongated outer shaft segment, a surface of the tubular insert may similarly operate as the first shaft retaining element.

A second rod retaining element 210 may be provided, extending radially outward from second outer peripheral surface of the second rod segment 162. As with the second shaft retaining element 208, the second rod retaining element 210 may be integrally formed with or otherwise secured or fixed to the second rod segment 162 by a mechanical interlock, an interference fit, a bonding material, and/or friction. While any appropriate material may be utilized, in at least one embodiment, the second rod retaining element 210 is formed of rubber material. In this way, the second rod retaining element 210 may be assembled onto the second rod segment 162 and maintained in position by friction or a combination of an interference fit and friction.

When the second rod segment 162 is assembled into the second elongated outer shaft segment 156, the second shaft retaining element 208 is disposed proximally to the second rod retaining element 210. That is, the second rod retaining element 210 is disposed between the second shaft retaining element 208 and the distal second shaft segment end 170 or the cleaning end 112 of the second subassembly 202.

In this way, telescoping movement of the second rod segment 162 outward from the second elongated outer shaft segment 156 is inhibited as the second shaft retaining element 208 obstructs the passage of the second rod retaining element 210, and, accordingly, the second rod segment 162. While the illustrated second rod retaining element 210 and the second shaft retaining element 208 are both illustrated as annular structures, those of skill in the art will appreciate that alternative structures may be provided, so long as there is an interference such that the second shaft retaining element 208 obstructs passage of the second rod retaining element 210. By way of example only, the second shaft retaining element 208 and second rod retaining element 210 may each extend less than a complete annulus, the second rod retaining element 210 may be an annular structure and the second shaft retaining element 208 may be a probe extending inwardly into the second elongated hollow interior 158 from the second elongated outer shaft segment 156, or the second rod retaining element 210 may be a probe extending outwardly from the second rod segment 162 and the second shaft retaining element 208 may be an annular structure.

It will thus be appreciated that the disclosed arrangement provides a reliable arrangement for maintaining the first and second rod segments 160, 162 within the respective first and second elongated outer shaft segments 152, 156. The arrangement may be economically manufactured and easily assembled. The arrangement further results in a reduced length profile for shipping. A smaller shipping box, for example, may reduce shipping costs by facilitating the shipment of a larger number of spray mops 100 in a given space.

Figure 5:
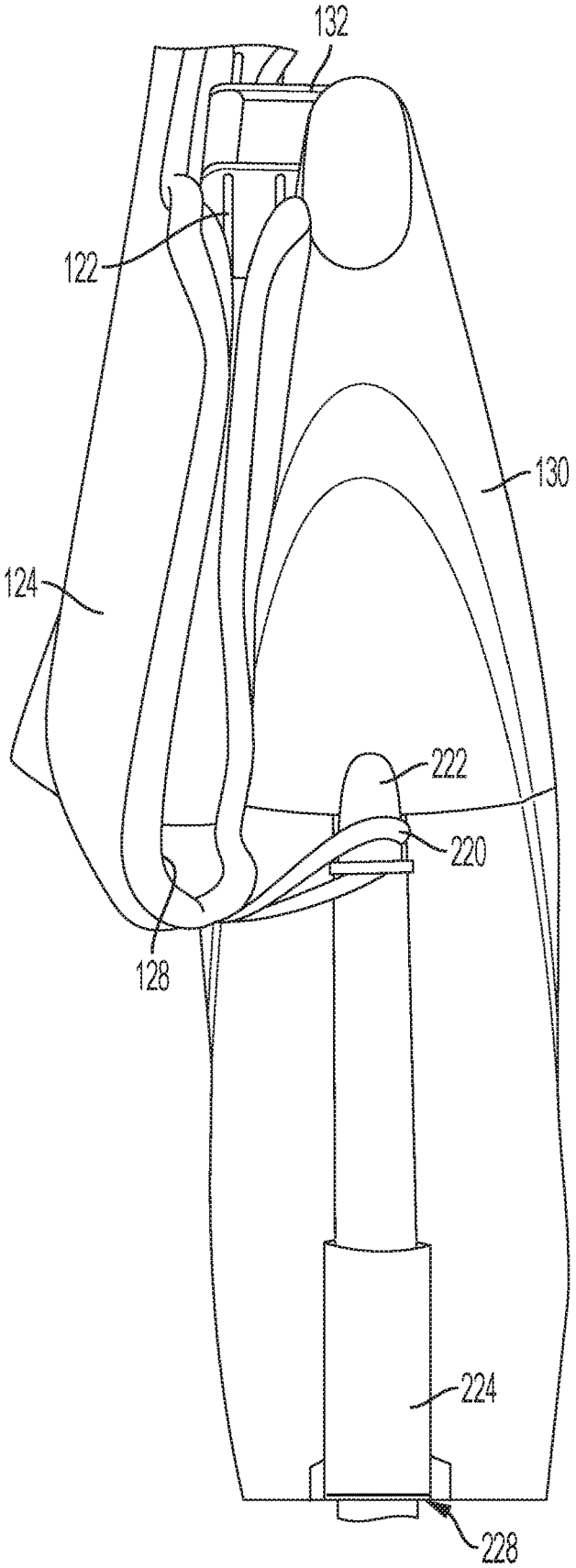
FIG. 5 is an enlarged fragmentary view of a storage position of the cleaning end of an embodiment of the spray mop of FIG. 1, illustrating a complementary coupling structure and measuring cup.

The spray mop 100 may include additional desirable features. For example, in order to deter undesired movement during storage or display, the spray mop 100 may include an arrangement by which the cleaning pad 124 disposed on the mop plate 122 may be temporarily coupled to the spray housing 130 in a second location (see FIG. 5). In accomplishing this objective, the cleaning pad 124 and the spray mop 100 may include complementary coupling structures adapted to couple an end of the cleaning pad 124 to the spray mop 100. As illustrated in FIG. 5, for example, the cleaning pad 124 may include a coupling structure, such as a loop 220 disposed toward one end of the cleaning pad 124, while the spray mop 100 includes a coupling structure, such as cleat 222 spaced from the multidirectional joint 132. In this way, the mop plate 122 and associated cleaning pad 124 may be pivoted to a position wherein a portion of the mop plate 122 is disposed substantially adjacent to the spray housing 130 such that the loop 220 may be disposed on the cleat 222 to hold the mop plate 122 in a position substantially parallel to the shaft 106. While the cleat 222 may extend from the spray housing 130, as illustrated in FIG. 5, those of skill in the art will appreciate that the cleat could alternatively extend from the outer shaft assembly 106 or the bottle 138. Those of skill in the art will further appreciate that alternative complementary coupling structures may be provided, or the illustrated coupling structures may be reversed. For example, the spray housing 130, outer shaft assembly 106, or bottle 138 may include a loop, while the cleaning pad 124 includes a hook disposed to engage the loop when the mop plate 122 is rotated to the position illustrated in FIG. 5.

Figure 6:
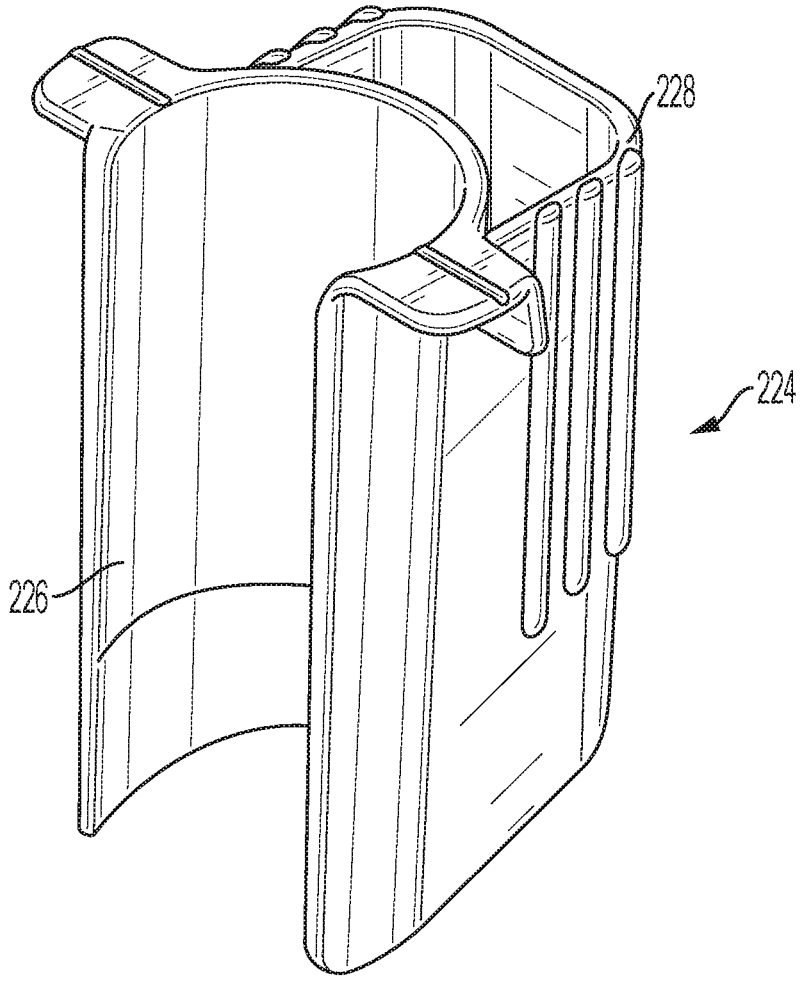
FIG. 6 is an enlarged isometric view of an embodiment of an optional measuring cup for the spray mop of FIG. 1.

By way of further example, the spray mop 100 may additionally include a measuring device to assist the consumer in preparing a cleaning solution to be utilized in the spray mop 100. Referring to FIGS. 5 and 6, a measuring cup 224 may be provided. In a particular embodiment, the measuring cup 224 is sized to provide a volume of cleaner to mixed with water to prepare enough cleaning solution to fill the bottle 138. The measuring cup 224 may be removably attached to the outer shaft assembly 106, for example, by a clip 226. In at least one embodiment, the clip 226 disposes the cup 224 at a location presenting a surface 228 in substantially the same plane as a surface of the bottle 138, but on an opposed side of the outer shaft assembly 106. In this way, the measuring cup 224 not only provides a convenient measuring device for the consumer, but may also be utilized to balance the spray mop 100 while hanging on a display hook.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A spray mop comprising:

a first subassembly including a first elongated outer shaft segment defining a first elongated hollow interior and having a proximal first shaft segment end and a distal first shaft segment end, a first shaft retaining element secured to and extending radially inward from the first elongated outer shaft segment into the first elongated hollow interior, a first elongated actuating rod segment disposed for telescoping movement within the first elongated hollow interior, the first elongated actuating rod segment having a first outer peripheral surface, a proximal first rod segment end, and a distal first rod segment end, a first rod retaining element extending radially outward from the first outer peripheral surface and coupled for movement with the first elongated actuating rod segment, a handle secured to the proximal first shaft segment end, a trigger movably coupled to the handle and disposed to selectively exert a force on the proximal first rod segment end to selectively telescope the first elongated actuating rod segment within the first elongated outer shaft segment, wherein the first rod retaining element is disposed between the first shaft retaining element and the handle, the first rod retaining element and the first shaft retaining element being sized to limit telescoping movement of the first elongated actuating rod segment from the first elongated outer shaft segment;

a second subassembly including a second elongated outer shaft segment defining a second elongated hollow interior and having a proximal second shaft segment end and a distal second shaft segment end, a second shaft retaining element secured to and extending radially inward from the second elongated outer shaft segment into the second elongated hollow interior, a mop plate coupled to the distal second shaft segment end, a selectively actuable spray assembly coupled to the second elongated outer shaft segment, a second elongated actuating rod segment disposed for telescoping movement within the second elongated hollow interior, the second elongated actuating rod segment having a second outer peripheral surface, a proximal second rod segment end, and a distal second rod segment end, the distal second rod segment end being disposed to selectively actuate the selectively actuable spray assembly, a second rod retaining element extending radially outward from the second outer peripheral surface and coupled for movement with the second elongated actuating rod segment, wherein the second rod retaining element is disposed between the second shaft retaining element and the distal second shaft segment end, the second rod retaining element and the second shaft retaining element being sized to limit telescoping movement of the second elongated actuating rod segment from the second elongated outer shaft segment;

wherein the distal first shaft segment end and the proximal second shaft segment end are adapted to be coupled together to align the distal first rod segment end with the proximal second rod segment end.

2. The spray mop of claim 1 wherein the distal first shaft segment end and the proximal second shaft segment end include engaging structures that secure the first shaft segment and the second shaft segment together.

3. The spray mop of claim 2 including a tubular insert including a radially extending surface, the radially extending surface of the tubular insert being disposed within the distal first shaft segment end and forming the first shaft retaining element or the radially extending surface of the tubular insert being disposed within the proximal second shaft segment end and forming the second shaft engaging segment.

4. The spray mop of claim 3 wherein the engaging structures include the tubular insert.

5. The spray mop of claim 3 wherein the tubular insert extends outward from the distal first shaft segment end or the proximal second shaft segment end and is adapted to couple to the other of the distal first shaft segment end or the proximal second shaft segment end.

6. The spray mop of claim 1 wherein the selectively actuable spray assembly includes a spray nozzle, and movement of the trigger causes a telescoping movement of the first and second elongated actuating rod segments within the first and second elongated outer shaft segments to actuate the selectively actuable spray assembly whereby a cleaning fluid is dispensed through the spray nozzle.

7. The spray mop of claim 1 wherein the first shaft retaining element interferes with the first rod retaining element to limit telescoping movement of the first elongated actuating rod segment within the first elongated outer shaft segment in a distal direction, and the second shaft retaining element interferes with the second rod retaining element to limit telescoping movement of the second elongated actuating rod segment within the second elongated outer shaft segment in a proximal direction.

8. The spray mop of claim 1 wherein at least one of the first shaft retaining element, the first rod retaining element, the second rod retaining element, and second shaft retaining element is an annular structure.

9. The spray mop of claim 1 wherein at least one of the first shaft retaining element, the first rod retaining element, the second rod retaining element, and second shaft retaining element is formed of rubber.

10. The spray mop of claim 1 wherein the first shaft retaining element is adapted to be disposed in the first elongated hollow interior and coupled to the first elongated outer shaft segment following disposition of the first rod segment and first rod retaining element within the first elongated hollow interior, and the second shaft retaining element is adapted to be disposed in the second elongated hollow interior and coupled to the second elongated outer shaft segment following disposition of the second rod segment and second rod retaining element within the second elongated hollow interior.

11. The floor mop of claim 1 further including a cleaning pad disposed on the mop plate, and a cleat coupled to the second elongated outer shaft segment and spaced from the mop plate, the mop plate being pivotably coupled to the second elongated outer shaft segment wherein the mop plate is pivotable to a position wherein the mop plate is disposed substantially parallel to the second elongated outer shaft segment, the cleaning pad including a loop disposed to engage with the cleat to couple the mop plate to the second elongated outer shaft segment in the position substantially parallel to the second elongated outer shaft segment.

12. The floor mop of claim 1 further including a measuring cup removably attached to the second elongated outer shaft segment.

13. An actuable shaft assembly for a spray mop assembly including an actuable spray assembly, a handle, and trigger, the actuable shaft assembly comprising:

a first elongated outer shaft segment defining a first elongated hollow interior and having a proximal first shaft segment end and a distal first shaft segment end, the proximal first shaft segment end being adapted to be secured to the handle, a first shaft retaining element secured to and extending radially inward from the first elongated outer shaft segment into the first elongated hollow interior, a first elongated actuating rod segment disposed for telescoping movement within the first elongated hollow interior, the first elongated actuating rod segment having a first outer peripheral surface, a proximal first rod segment end, and a distal first rod segment end, a first rod retaining element extending radially outward from the first outer peripheral surface and coupled for movement with the first elongated actuating rod segment, wherein the first rod retaining element is disposed between the first shaft retaining element and the proximal first shaft segment end, the first rod retaining element and the first shaft retaining element being sized to limit telescoping movement of the first elongated actuating rod segment outward from the distal first shaft segment end;

a second elongated outer shaft segment defining a second elongated hollow interior and having a proximal second shaft segment end and a distal second shaft segment end, a second shaft retaining element secured to and extending radially inward from the second elongated outer shaft segment into the second elongated hollow interior, a second elongated actuating rod segment disposed for telescoping movement within the second elongated hollow interior, the second elongated actuating rod segment having a second outer peripheral surface, a proximal second rod segment end, and a distal second rod segment end, a second rod retaining element extending radially outward from the second outer peripheral surface and coupled for movement with the second elongated actuating rod segment, wherein the second rod retaining element is disposed between the second shaft retaining element and the distal second shaft segment end, the second rod retaining element and the second shaft retaining element being sized to limit telescoping movement of the second elongated actuating rod segment from the proximal second shaft segment end;

wherein the distal first shaft segment end and the proximal second shaft segment end are adapted to be coupled together to align the distal first rod segment end with the proximal second rod segment end.

14. The actuable shaft assembly of claim 13 wherein the first shaft retaining element is secured to the first elongated outer shaft segment by at least one of a mechanical interlock, an interference fit, friction, and a bonding agent, and the second shaft retaining element is secured to the second elongated outer shaft segment by at least one of a mechanical interlock, an interference fit, friction, and a bonding agent.

* * * * *